United States Patent [19]

Wells

[11] Patent Number: 4,553,528

[45] Date of Patent: Nov. 19, 1985

[54] FREE-STANDING STOVE AND FIREPLACE APPARATUS

[76] Inventor: William T. Wells, P.O. Box 7097, Tucson, Ariz. 85725

[21] Appl. No.: 336,886

[22] Filed: Jan. 4, 1982

[51] Int. Cl.[4] ..... F24B 7/00

[52] U.S. Cl. ..... 126/123; 126/126; 126/131; 126/77; 237/51

[58] Field of Search ..... 126/121, 123, 126, 131, 126/67, 76, 77, 307 R, 61, 63, 58, 15 R, 4, 6; 98/58, 60; 237/51

[56] References Cited

U.S. PATENT DOCUMENTS

| | | | |
|---|---|---|---|
| 93,427 | 8/1869 | Fleming | 126/15 R |
| 2,453,954 | 11/1948 | Wright | 237/51 |
| 2,821,900 | 2/1958 | Primich | 98/58 X |
| 2,863,443 | 12/1958 | Hoffman | 126/121 |
| 2,898,839 | 8/1959 | McKann | 126/307 R |
| 3,952,721 | 4/1976 | Patterson | 126/126 X |
| 4,043,313 | 8/1977 | Sherman | 126/121 |
| 4,129,113 | 12/1978 | Bergstrom | 126/121 |
| 4,163,440 | 8/1979 | Stultz | 126/77 X |
| 4,180,052 | 12/1979 | Henderson | 126/126 X |
| 4,223,833 | 9/1980 | Ebbers | 126/131 X |
| 4,254,756 | 3/1981 | Wells | 126/121 |
| 4,325,353 | 4/1982 | Husa | 126/131 X |
| 4,349,009 | 9/1982 | Patterson et al. | 126/131 X |
| 4,365,142 | 12/1982 | Alin | 126/116 C X |

FOREIGN PATENT DOCUMENTS

| | | | |
|---|---|---|---|
| 563189 | 8/1944 | United Kingdom | 126/121 |

*Primary Examiner*—Larry Jones

*Attorney, Agent, or Firm*—H. Gordon Shields

[57] ABSTRACT

Free-standing stove/fireplace apparatus includes a plurality of heated air chambers disposed about a firebox and flue, with air intake and air outlet passages located at various heights for the convection heating of air in the room in which the apparatus is disposed and with provisions for utilizing outside air for combustion purposes to allow the firebox to be isolated from the room air.

25 Claims, 11 Drawing Figures

FREE-STANDING STOVE AND FIREPLACE APPARATUS

BACKGROUND OF THE INVENTION

1. Field of the Invention

This invention relates to heating apparatus, and, more particularly, to free-standing stove/fireplace apparatus for heating purposes.

2. Description of the Prior Art

U.S Pat. No. 4,254,756 discloses a fireplace insertable into an existing masonry fireplace. The apparatus of the '756 patent, invented by the inventor of the present invention, utilizes outside air for combustion.

U.S. Pat. No. 4,135,488, also by the inventor of the present invention, also utilizes outside air for combustion purposes. The apparatus of the '488 patent is designed as a fireplace and, like the '756 apparatus, includes a plurality of chambers through which room air circulates for heating purposes.

Another fireplace/furnace apparatus which utilizes a plurality of heated air chambers for heating purposes and an outside air source for combustion purposes is disclosed in U.S. Pat. No. 4,180,052.

The patents discussed above are designed, generally speaking, as fireplace/furnace apparatus. Some of the embodiments of the '052 patent may be utilized for cooking purposes, and accordingly include a flat top or a flat portion, or a chamber, for cooking purposes. However, the '052 apparatus is designed to be disposed against a wall and it may be bricked in, at least in part, not unlike a fireplace installation. None of the apparatus discussed in the preceding patents are designed as free-standing units, spaced apart from a wall and communicating with the exterior of a structure only through the ceiling.

As is understood, negative pressure problems arise within a closed structure when room air is used for combustion purposes, as in a "common" fireplace and particularly as in free-standing fireplaces of the prior art. With combustion and room air separated, as in the apparatus in the above-discussed and referenced patents, negative air pressures are not created due to the separation of the two air systems.

SUMMARY OF THE INVENTION

The invention described and claimed herein comprises a fireplace/stove apparatus in a free-standing configuration, spaced apart from walls of a structure having two air systems, one for combustion purposes and one for heating purposes, with the combustion air drawn from outside the structure in which the apparatus is located. The heated air system is drawn into the apparatus at various lower levels in the room in which the apparatus is located and flows out of the apparatus also at higher levels.

The heated air flows through various chambers disposed about the combustion chamber and about the flue through which combustion gases flow. Baffled outside air is used for cooling the flue through the ceiling, attic, and roof portions of the structure in which the apparatus is disposed, and a rain cap and spark arrest are disposed on top of the flue externally of the structure in which the apparatus is disposed.

Among the objects of the present invention are the following:

To provide new and useful fireplace apparatus;

To provide new and useful free-standing fireplace apparatus;

To provide new and useful fireplace/stove apparatus;

To provide new and useful heating apparatus having an outside air source for combustion purposes;

To provide new and useful apparatus for heating and cooking purposes;

To provide new and useful rain cap and spark arrestor apparatus for a chimney flue;

To provide new and useful apparatus for cooling a chimney flue;

To provide new and useful furnace apparatus having a plurality of heated air chambers disposed about a combustion chamber and a flue;

To provide new and useful heating apparatus having a plurality of heated air chambers disposed about a firebox and flue with different levels of air intake and outflow for the chambers; and To provide new and useful fireplace/stove apparatus free-standing in a structure and having three separated air systems for combustion and for cooling purposes.

DESCRIPTION OF THE PREFERRED EMBODIMENT

Figure 1:
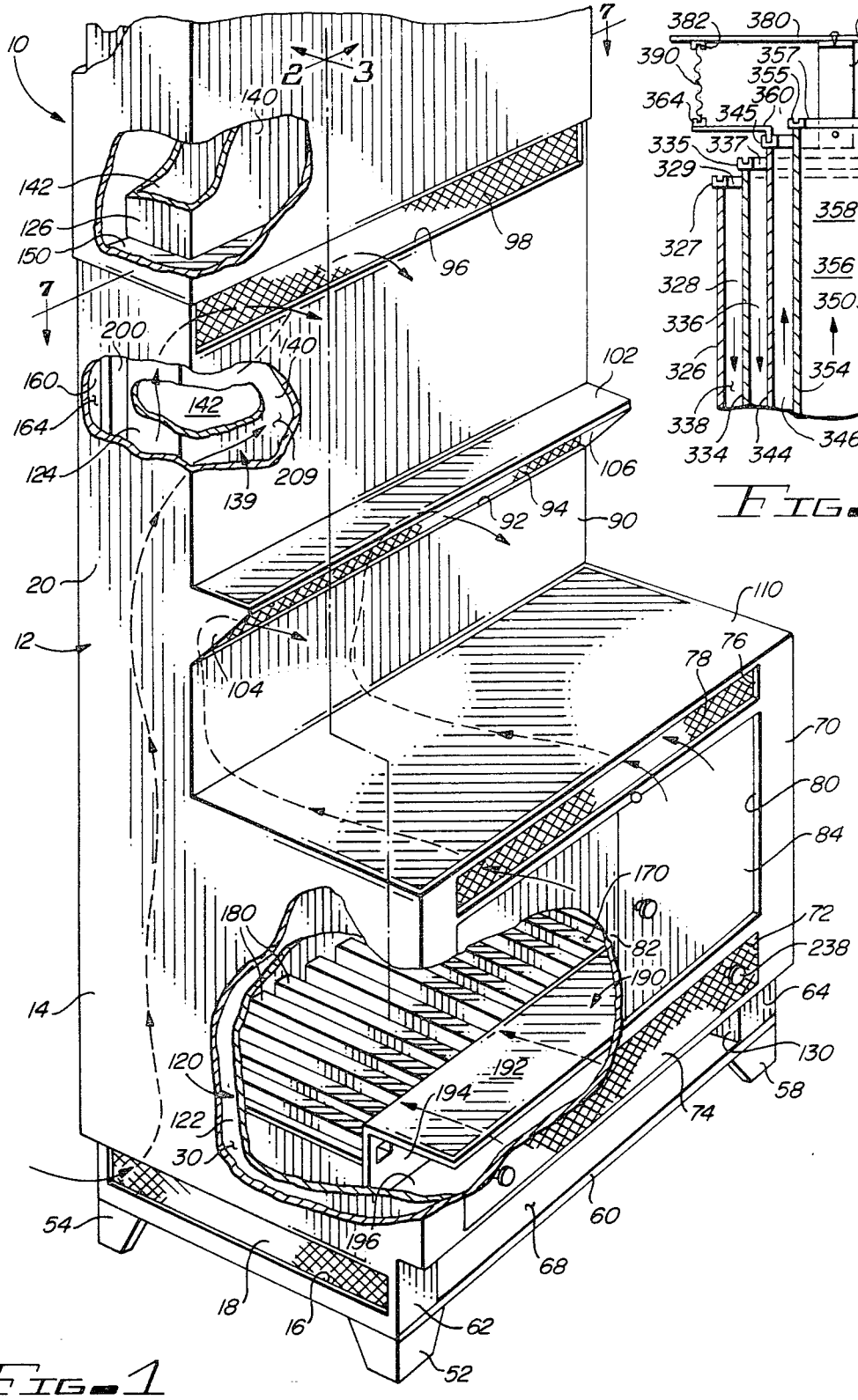
FIG. 1 is a perspective view, with portions broken away, of the apparatus of the present invention.
Figure 2:
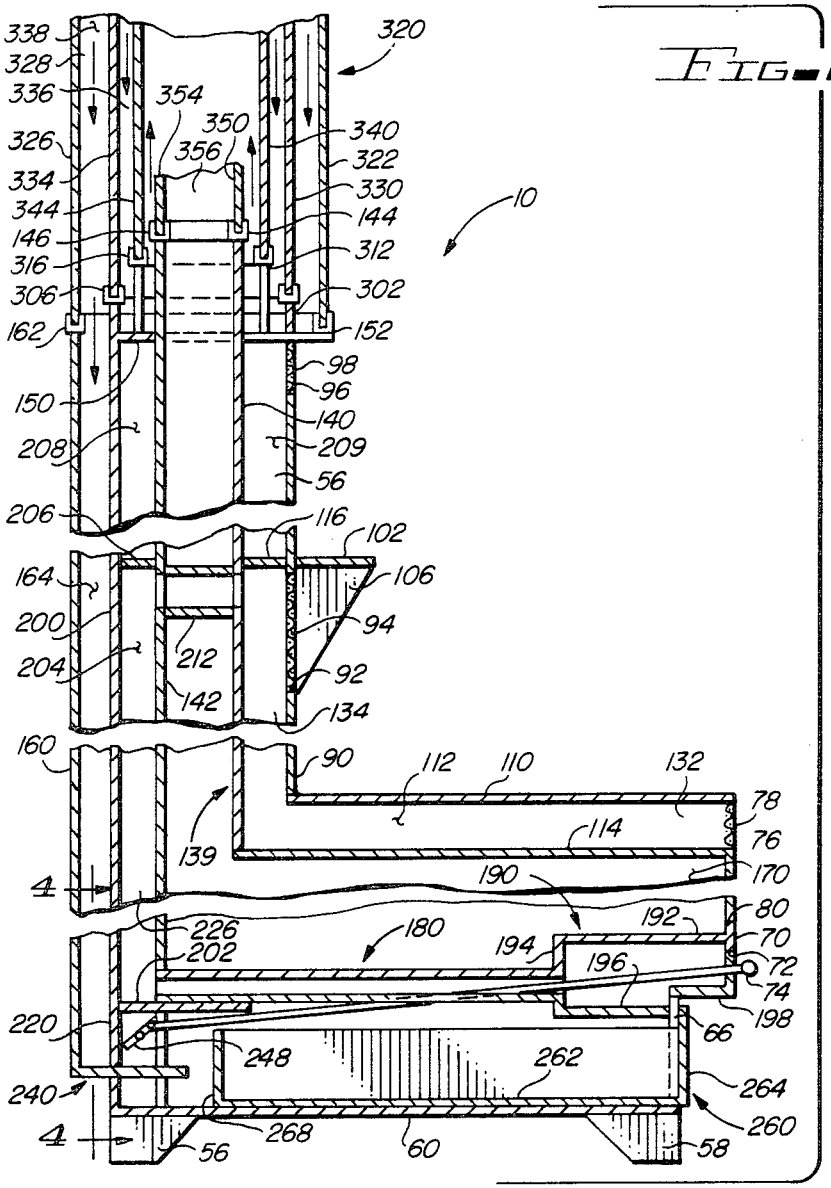
FIG. 2 is a side view in partial section of the apparatus of FIG. 1, taken generally along line 2—2 of FIG. 1.
Figure 3:
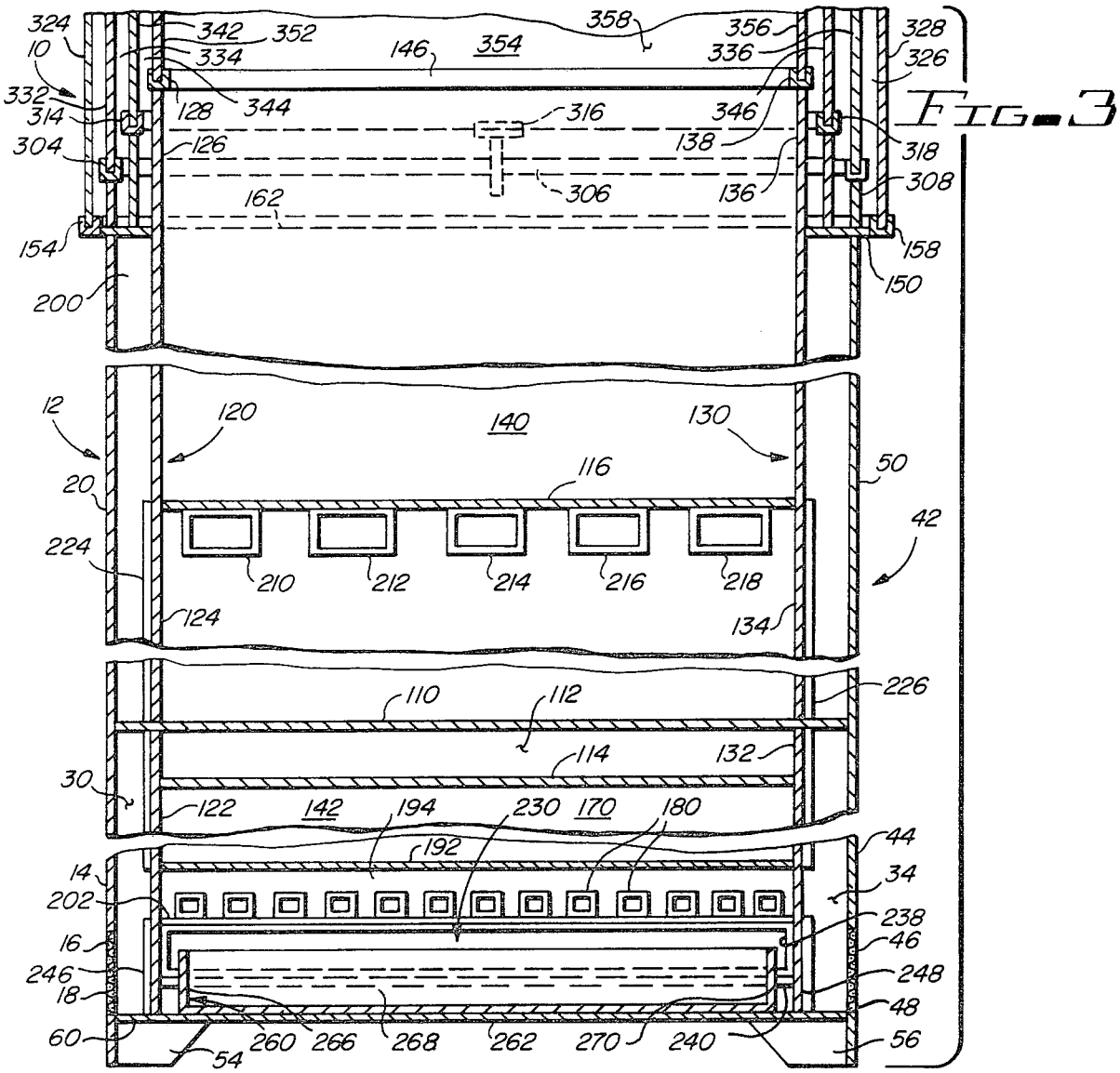
FIG. 3 is a front view of the apparatus of the present invention, in partial section, taken generally along line 3—3 of FIG. 1.

FIG. 1 is a perspective view of free standing stove/-fireplace apparatus 10 of the present invention. FIG. 2 is a side view in partial section of the free standing stove/-fireplace apparatus 10 of FIG. 1, taken generally along line 2—2 of FIG. 1. It comprises a side view of the free standing stove/fireplace apparatus 10. FIG. 3 is another view in partial section of the free standing fireplace/-stove apparatus 10, taken generally along line 3—3 of FIG. 1. It comprises a general front view of the fireplace/stove apparatus 10. For the following discussion, reference will primarily be made to FIGS. 1, 2, and 3.

Specific references will be made to other Figures for various details as the details are discussed.

The free standing fireplace apparatus 10, generally speaking, includes two portions, a lower portion, which includes a firebox and chambers disposed about the firebox through which heated air flows, and an upper portion, which includes a flue and various chambers disposed about the flue through which flows both air to be heated and combustion air drawn downwardly into the combustion chamber. Thus, the free standing stove/fireplace or stoveplace apparatus 10 includes two separate air systems, a combustion air system and a heated air system.

The combustion air is drawn downwardly from the exterior of the building or structure in which the apparatus is disposed, and at the same time, air to be heated from within the structure circulates both about the combustion chamber and about the flue where heat is exchanged. Two separate air systems help to utilize heat provided by combustion for heating the room and for cooling the stack or flue. The cooling of the flue simplifies the insulation of the flue as it extends through the ceiling and the roof of the structure (house) in which the apparatus is located.

The free standing stove/fireplace apparatus 10 includes a pair of outer side walls 12 and 42 which are of a general "L" shaped configuration, and both of which include a lower portion and an upper portion. The side wall 12 includes a lower portion 14 and an upper portion 20. The side wall 42 includes a lower portion 44 and an upper portion 50.

The lower portions 14 and 44 both include inlet openings 16 and 46, respectively, which are covered with mesh or screens 18 and 48, respectively. The openings 16 and 46 are disposed at the bottom of the lower portions, nearest the floor. Air to be heated from within the room or structure in which the apparatus 10 is located flows into the apparatus 10 through the mesh or screen covered openings and into a pair of side heated air chambers 30 and 34, which are best shown in FIG. 3.

The outer side plates or walls 12 and 42 extend upwardly from a bottom plate 60 to which they are appropriately secured, as by welding. The walls 12 and 42 are substantially parallel to each other and are disposed substantially perpendicularly to the bottom plate 60. The plate 60 is generally rectangular in configuration, and to it is secured a plurality of plates or walls which comprise both inner and outer walls. The plates 12 and 42 are outer side walls for the apparatus 10.

Supporting the stoveplace apparatus 10 are four legs 52, 54, 56, and 58. The legs 52 . . . 58 are secured to and extend downwardly from the bottom plate 60. The stoveplace apparatus 10 is thus spaced apart upwardly, or supported above, from a floor (not shown) in any room in which it is situated.

At the front of the stove/fireplace apparatus 10 is a pair of bottom front side plates 62 and 64. The plates 62 and 64 extend upwardly from the bottom plate 60 and inwardly from the lower outer side walls 14 and 44, respectively. The plates 62 and 64 terminate upwardly at a bottom front plate 198. The bottom front plate 198 is best shown in FIG. 2. The bottom front plate 198 extends between the outer side walls 14 and 24, and is generally horizontally disposed.

Parallel to the bottom front side plates 62 and 64 and extending upwardly from the bottom front plate 198 is a front lower vertical plate 70. The plate 70 extends between the lower portions 14 and 44 of the outer side plates 12 and 42, respectively.

An elongated rectangular opening 72 is disposed above the plate 198 at the lower portion of the lower front plate 70. The opening 72 is covered with mesh or screen 74. Room air to be heated flows through the mesh 74 in the opening 72, as will be discussed in detail below. The opening 72 is centrally located between the outer side walls 12 and 42 and is the same width as the spacing between the plates 62 and 64.

The front plate 70 includes a second or upper opening 76 at its top or upper portion, substantially parallel to the lower opening 72. The opening 76 is covered with mesh or screen 78. The opening 76 also receives a flow of room air to be heated, as does the opening 72.

The front plate 70 also includes a third, or firebox, opening 80. The opening 80 is disposed between the openings 72 and 76. A pair of glass doors 82 and 84 closes the opening 80. The doors 82 and 84 are appropriately hinged to the plate 70 and, when closed, seal the plate 70 to prevent room air from flowing through the opening 80 and mixing with combustion air. This, of course, prevents negative pressure problems from developing in a substantially sealed room, home, or building.

The plates 62 and 64, as best shown in FIGS. 1 and 2, are recessed rearwardly from the plate 70. A relatively short, height-wise, plate 66 extends between the plates 62 and 64 and downwardly from the plate 198. The plate 66 is shown in FIG. 2.

Spaced apart inwardly from the outer walls or side plates 12 and 42 are a pair of inner side walls 120 and 130, respectively. The inner side walls 120 and 130 are divided into two portions. The inner side wall 120 includes a lower portion 122 and an upper portion 124. The inner side wall 130 includes a lower portion 132 and an upper portion 134.

The respective portions of the inner side walls or side plates 120 and 130 are generally L-shaped, like the outer side plates or outer walls 12 and 42, as may be best understood from FIGS. 1 and 2. The outer and inner side walls are paired, with the walls of each pair spaced apart from each other. Plates 12, 120 and 42, 130 comprise the pairs.

An opening 68 is defined above the bottom plate 60, beneath the bottom front plate 198 and the plate 66, and between the bottom side plates 62 and 64 and the inner side walls 120 and 130 at the bottom of their lower portions 122 and 132, respectively. This is best shown in FIGS. 1 and 2. The opening 68 receives an ash tray 260.

A horizontal plate 110 extends between the outer side walls 12 and 42 and divides the outer side walls and the inner side walls, all of which the plate 110 is attached to, into their respective two portions 14, 24 and 44, 54 for the outer side walls 12 and 42, respectively, and 122, 124 and 132, 134 for the inner side walls 120 and 130, respectively. The lower portions 122 and 132 of the inner side walls 120 and 130, respectively, and the lower portions 14 and 44 of the outer side walls 12 and 42, respectively, extend upwardly between the bottom plate 60 and the horizontal plate 110. As best shown in FIGS. 1 and 2, the horizontal plate 110 defines the counter top or stove top for the stove place apparatus 10.

Rearwardly of the horizontal plate 110, the outer side walls 12, 42 and the inner side walls 120, 130 extend upwardly to a collar 150.

The horizontal plate 110 is secured to the upper portion of the lower front vertical plate 70 and to the outer side plates 12 and 42 and to the inner side plates 120 and 130. The plate or stovetop 110 extends rearwardly from the front plate 70 to a front or middle plate 90.

The plate 90 is vertically extending and is substantially parallel to the lower front plate 70. The front plate 90 may be referred to as a vertical front middle plate to distinguish it from the front lower plate 70. The plate 90 extends from the stove top 110 upwardly to a collar plate 150.

The front middle plate 90 includes two openings, both of which are warm air outlet openings. The lower of the two openings is an opening 92 which is preferably covered with a mesh or screen 94. The upper of the two openings is an opening 96, which is preferably covered by a mesh or screen 94. The openings 92 and 96 serve as the outlet for the warm air from the chambers 30 and 34, as discussed above, and as will be discussed in more detail below.

Extending between the inner side wall portions 122 and 132, and spaced downwardly from, and substantially parallel to, the stove top plate 110, is a horizontal plate 114. The plate 114 extends rearwardly from the lower front plate 70 at the top of the door opening 80. The plate 114 extends rearwardly from the lower front plate 70 to the bottom of a flue front wall 140. The flue front wall 140 is also shown best in FIGS. 2 and 3. The plate 114 defines the top or roof of a combustion chamber 170.

The flue front wall 140 extends upwardly between the inner side walls 122 and 132, to which it is appropriately secured, as by welding. The wall 140 terminates slightly above the collar 150, as will be discussed in detail below.

Figure 4:
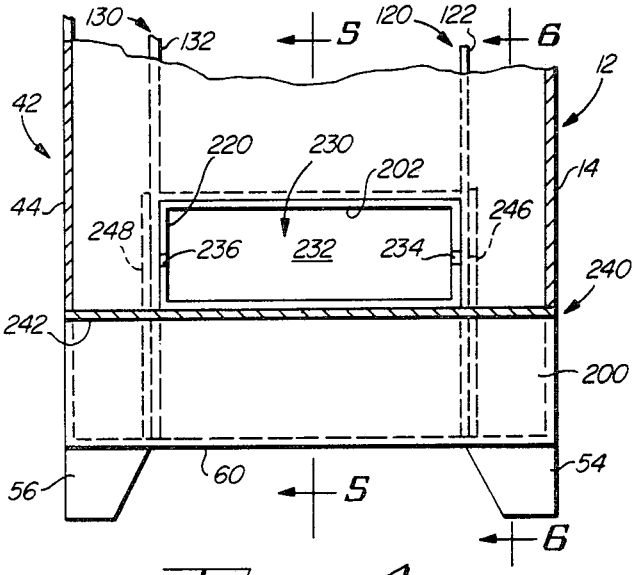
FIG. 4 is a view in partial section of the apparatus of the present invention taken generally along line 4—4 of FIG. 2.
Figure 5:
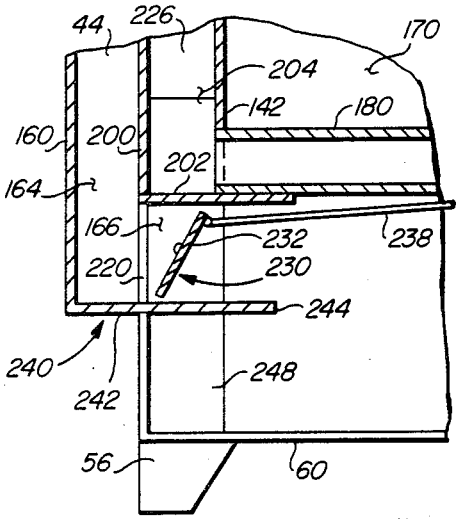
FIG. 5 is a view in partial section of the apparatus of the present invention taken generally along line 5—5 of FIG. 4.
Figure 6:
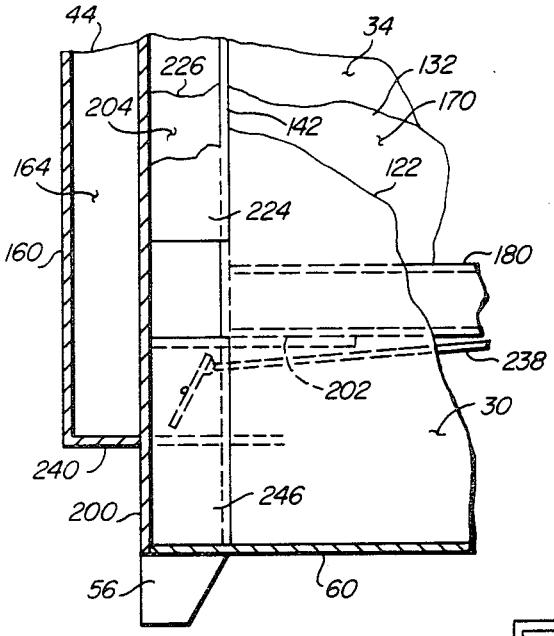
FIG. 6 is a view in partial section of a portion of the apparatus of the present invention taken generally along line 6—6 of FIG. 4.

A plate 160, generally rectangular in configuration, comprises the rear wall or back plate for the stoveplace apparatus 10. The outer side walls 12 and 42 are appropriately secured to the vertical sides of the plate 160. As shown in FIGS. 1 and 2, and best shown in FIGS. 5 and 6, the back plate 160 terminates above the bottom plate 60. FIG. 4 is a view in partial section taken along line 4—4 of FIG. 2, and FIGS. 5 and 6 are views in partial section taken respectively along lines 5—5 and 6—6 of FIG. 4. All three Figs. disclose details of the lower rear portion of the stoveplace 10.

Spaced apart inwardly a relatively short distance from the back plate or rear wall 160 is an inner rear wall or inner back plate 200. The inner back plate or wall 200 extends the width of the apparatus 10 and is appropriately secured, as by welding, to the outer side walls 12 and 14. The inner back plate 200 extends upwardly to the collar 150 to which it is appropriately secured, as by welding.

The back plate 160 extends upwardly to the collar 150, which is secured to the vertical edges of the plate 160. A U-bend channel 162 is secured to the top of the plate 160 to receive a mating plate or panel in a chimney or flue section, as will be described below.

Between the back plate 160 and the inner back plate 200 and the outer side walls 12 and 42 is defined a combustion air channel or passage 164. Combustion air for a firebox or combustion chamber 170 flows downwardly in the channel 164 from outside the structure (home) in which the free standing stoveplace apparatus 10 is disposed. Thus, fresh, outside air is brought in and used for combustion purposes. Room air is used only for heating purposes, and not for combustion.

The firebox or combustion chamber 170 is defined between the inner side wall lower portions 122 and 132 and beneath the horizontally extending plate or baffle 114.

At the back or rear of the firebox 170 is a plate 142 which also comprises the rear flue wall. The rear flue wall 142 is spaced apart from the front flue wall 140 and is substantially parallel to it. The rear flue wall 142 terminates above the collar 150 at the same height as the front flue wall 140. A chimney flue 139 is defined by the plates or walls 140, 142, and the flue portions of the plates or walls 120, 130.

Each inner side wall includes a flue portion which extends upwardly from the collar 150. The inner side wall 120 includes an upper flue portion 126 and the inner side wall 130 includes an upper flue portion 136. The upper flue portions 126 and 136 are appropriately secured to the front flue wall 140 and the rear flue wall 142, as by welding. It will be understood that below the collar 150, the sides of the flue are defined by the inner side wall upper portions 124 and 134 above the plate 110, and the lower portions 122 and 124 between the plates 110 and 114 above the combustion chamber or firebox 170. Thus, parts of the inner side walls 120 and 130 define the sides of the combustion chamber and the chimney flue. The various plates or plate portions are appropriately secured, as by welding, to define and to seal the sides and top of the combustion chamber 170 and the chimney flue which carries combustion gases away from the combustion chamber.

Figure 9:
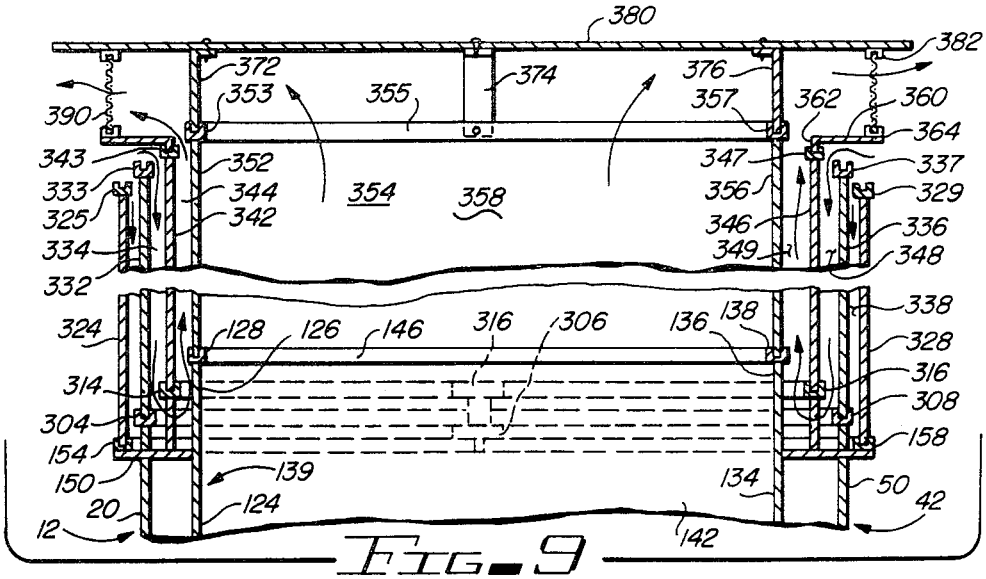
FIG. 9 is a view in partial section of a portion of the apparatus of FIG. 8, taken generally from line 9—9 of FIG. 8.

On the top of the four plates which comprise the flue 139, namely the plates 140, 142, 126, and 136, are secured four U-bend elements 144, 146, 128, and 138, respectively. The four U-bend elements 144, 146, 128, and 138 are disposed in a rectangular pattern above the collar 150. This is best shown in FIGS. 2, 3, and 9.

The lower part of the combustion chamber 170 includes a plurality of horizontally extending grates 180. Each of the grates 180 comprises a sheet metal tube having generally a square or rectangular cross-sectional configuration. The grates 180 are generally parallel to each other and they extend horizontally front to rear with respect to the apparatus 10.

At the front of the free-standing stove/fireplace or stoveplace 10, the grates are secured to a manifold 190. The manifold 190 includes a top plate 192, a rear plate 194, and a bottom plate 196. The plates 66, 198, and 70 are also a part of the manifold 190, as are the inner side plates 122 and 132. The front of the manifold 190 is defined by the portion of the lower front plate 70 and the air intake opening 72. The plates 66 and 198 define an inverted step. The rear plate 194 includes a plurality of square or rectangular openings which mate with the front portions of the plurality of grates 180. The sides of the header or manifold 190 are closed by the adjacent portions of the inner side walls 122 and 132. Air flows into the manifold or header 190 through the screen 74 in the lower front opening 72.

The rear ends of the grates 180 extend to the rear flue wall 142, where they are appropriately secured to the wall 142 in alignment with a plurality of apertures extending through the wall or plate 142 and through which the air flows. The wall or plate 142 has its lower termination adjacent to the bottom of the grates 180. A plate 202 is secured to the bottom of the wall 142, to the wall 200, and to the inner side walls 122 and 132 and to the grates 180. The plate 202 extends forwardly of the rear flue wall 142 and beneath the grates 180 for a short distance, as shown in FIGS. 2 and 9. The bottom wall 202 defines the bottom of a heated air chamber 204 between the walls 142 and 200, and the upper rear bottom of the heated air chambers 30 and 34.

Room air flows through the screen 74 in the lower opening 72 and into the manifold 190. The air then flows from the manifold 190 through the grates 180 and through the rear flue wall 142 into the space or chamber 204 between the rear flue wall 142 and the inner rear wall 200.

Between the rear flue wall 142, the rear chamber wall 200, the bottom plate 202, and the collar 150, there are two heated air chambers. The two chambers include a lower chamber 204 and an upper chamber 208. The chambers 204 and 208 are separated by a horizontal plate 206.

Another horizontal plate 116 extends between the front side plate 90 and the front flue wall 140 and between the inner side plate portions 124 and 134. The plate 116 is preferably located at about the center of the upper portions 124 and 134 of the inner side walls 120 and 130, respectively. The horizontal plate 116 is appropriately secured to the respective portions of the inner side walls, the front wall and flue wall, in an appropriate manner, as by welding, to provide air-tight seams, as are all of the other seams for the side walls, front walls, horizontal plates, etc., as discussed herein. The plates 116 and 206 are in general horizontal alignment, as best shown in FIG. 2. Above plate 116 is a heated air chamber 209, bounded by the walls 90, 140, 124, 134, and collar 150.

A heated air chamber 112 is defined between the horizontal plates 114, 110, and 116, the front plate 70, the flue front wall 140, and the portions 122, 124 and 132, 134 of the inner side walls 120 and 130, respectively, as best shown in FIGS. 2 and 3. The chamber 112 is of an L-shaped configuration, as seen from the side, such as in FIG. 2. Air to be heated flows into the chamber 112 through the screen or mesh 78 in the opening 76 of the front plate 70, and flows rearwardly in the chamber 112 and then upwardly in the chamber 112 between the vertical front middle plate 90 and the flue front plate 140. The air heated in the chamber 112 flows outwardly from the chamber 112 through the mesh or screen 94 in the opening 92.

As best shown in FIGS. 1 and 2, a horizontally extending plate or shelf 102 is secured to the plate 90 above the opening 92. The shelf 102 includes a pair of triangularly shaped shelf supports 104 and 106. One of the functions of the shelf 102 is to direct the warm air flowing out of the opening 92 into the room in which the apparatus 10 is located. The shelf supports 104 and 106 act as baffles to help direct the flow of heated air outwardly from the stove/fireplace apparatus 10. The flow of air into, through, and out of the chamber 112 is shown by appropriate arrows in FIG. 1.

From FIG. 1, it will be noted that the width of the opening 76 for the chamber 112 in the front plate 70 is less than the full width of the apparatus 10. The reason for this is that the opening 78 extends only between the inner side wall plate lower portions 122 and 132, as may be best understood from FIG. 3. This provides for the separation of air flows in chambers 112, 30, and 34, and allows the heated air chambers 30 and 34, as also shown in FIG. 3, to extend to the full height of the inner and outer side walls upwardly to the collar 150 from the lower plate 60, as also shown in FIG. 3.

Rearwardly of the horizontal plate 110, the chambers 30 and 34 extend upwardly along the sides of the apparatus 10. The chambers 32 and 34 are accordingly generally L-shaped. The chambers 30 and 34 are open to the chambers 208 and 209 above the plates 206 and 116, respectively.

The outer or lateral portions of the inner rear wall 200, which extend between the outer side walls 12 and 42, defines the back or rear portion of the heated air chambers 30 and 34. At the lower part of the inner rear wall 200 there is an opening 220. The opening 220 is generally of a rectangular configuration. The opening 220 extends between the lower portions of the inner side walls 120 and 130, as shown in FIG. 4. The plate 202, which defines the bottom of the heated air chamber 204 between the rear flue wall 142 and the inner back wall 200, is secured to the wall 200 at the top of the opening 220. The plate 202 extends forwardly from the upper portion or top of the opening 220 at the inner rear wall 200.

A plate 240 extends through the opening 220 at the bottom of the opening. The plate 240 extends forwardly from the bottom of the outer rear wall 160 and through the bottom of the opening 220. The plate 240 is in the general configuration of a squat "T". It includes a cross member 242 and a leg 244. The tongue or leg 244 of the "T" extends through the opening 220, while the cross member or wide portion 242 of the "T" extends only between the outer rear wall 160 and the wall 200 and laterally on each side of the opening 220. The sides of the cross bar or cross member of the "T" extend between the outer side walls 14 and 44, as indicated in FIGS. 4 and 5. The plate 240 accordingly defines not only the bottom of the combustion air passage 164, but a portion of the plate 240 extends forwardly through the opening 220 to define the bottom of a passageway 166 for the combustion air as it extends through the opening 220 beneath the grates 180.

The flow of combustion air from the combustion channel 164 through the opening 220 is controlled by an air valve 230. The air valve 230 includes a movable vane 232 which is pivotally secured to a pair of posts or pins 234 and 236. The posts or pins 234 and 236 are appropriately secured to a pair of plates 246 and 248. The plates 246 and 248 comprise a pair of generally vertically extending gussets or plates which are secured to the bottom plate 60, the inner rear wall 200 upwardly to the horizontally extending plate 202, and to the inner side walls 122 and 132, respectively. They comprise a pair of plates which seal the flow of combustion air from the chamber or passage 164 from the heated air chambers 30 and 34.

The upper portion of the plates or gussets 246 and 248 above the leg 244 define the sides of an air passageway 166, best shown in FIG. 5, in which the air valve 230 is disposed. The passage 166 provides an appropriate communication for the flow of air between the combustion air channel or chamber 164 to the firebox 170.

While the plates 246 and 248 are shown in FIGS. 3, 4, 5, and 6 as being two discrete plates, it is obvious that they may be rearwardly extending extensions or panels of the inner side walls 122 and 132 beyond the flue wall 142.

A control rod 238 is secured to the vane 232 and extends forwardly to terminate just outside the front of the stoveplace apparatus 10 through the opening 72. Movement of the control arm 238 positions the vane 232 of the air valve 230 to provide the proper flow of air to the passage 166 from the combustion air channel 164 for the desired combustion within the firebox 170.

The ashtray 260 comprises a generally rectangularly shaped box which extends through the opening 68 (see FIG. 1) above the bottom plate 60 and beneath the grate manifold 190.

The ashtray 260 includes a bottom 262, a front wall 264, a side wall 266, a rear wall 268, and a side wall 270. The four walls are secured to the bottom 262 and to each other, as is well known and understood. They may be made of sheet metal, fairly lightweight, as desired and appropriate.

The side walls 266 and 270 and the rear wall 268 of the ashtray 260 are all the same height. The front wall 264 is higher and wider than the sides and rear wall. It extends upwardly, above the other three walls and overlaps the downwardly extending cross front plate 66 against which it is disposed. The height of the other three walls 266, 270, and 268 is dimensioned to fit between the bottom plate 60 and the bottom of the cross plate 66.

For sealing the sides of the opening 68, the front wall 264 of the ashtray 260 is wider than the bottom plate 262, and extends outwardly to overlap the lower front plates 62 and 64 at the inner side wall portions 122 and 132 to the bottom plate 60. The front wall 264 thus provides a seal to prevent room air from mixing with the flow of combustion air beneath the grates 180 from the air valve 230.

The length of the ashtray 260 from the front wall 264 to the rear wall 268 is sufficient to allow the ashtray to extend beneath a portion of the plate 202 and underneath the grates 180.

The ashtray 260 also includes a handle, not shown, for convenience in moving the ashtray, and the ashes disposed therein.

Air flowing through the passage 166 and past the air valve 230 is directed forwardly between the lower portions of the inner side walls 122 and 132 and between the horizontally extending plates 202 and 240. The combustion air then flows upwardly, above the ashtray 260, and upwardly between the grates 180 to provide for the combustion for the fuel disposed on the grates 180 within the combustion chamber 170.

As discussed above, the portion of the plate 202 between the inner rear wall 200 and the rear flue wall 142 comprises the bottom of a warm air chamber 204. The warm air chamber 204 communicates with the side warm air chambers 30 and 34 in the lower portion of the apparatus, but to separate the vertical flows of air in the chamber 204 from the flows of air in the chambers 30 and 34, a pair of gussets 224 and 226 extend between the inner rear walls 200 and the respective inner side walls 120 and 130. The gussets 224 and 226 are spaced apart above the lower gussets or plates 246 and 248 to allow air to flow from the chambers 30 and 34 into the lower part of the chamber 204. See particularly FIGS. 3, 4, 5 and 6. The gussets 224 and 226 extend upwardly to the height of the horizontally extending plate 116. Accordingly, air that flows from the side chambers 30 and 34 into the chamber 204 between the bottom of the gussets 224 and 226 and the top of the gussets 246 and 248, and air flowing into the chamber 204 from the grates 180, remains in the chamber 204 until it is blocked by the horizontal plate 206. Air that remains in the chambers 30 and 34 flows vertically upwardly until it is above the plate 206 when it can flow into the upper air chamber 208 and out of the stoveplace apparatus through the mesh 98 in the opening 96 in the upper front plate 90 at the front of chamber 209.

Communication between the chamber 204 and the upper portion of the chamber 112 is through a plurality of tubes 210, 212, 214, 216, and 218. The tubes are generally horizontally extending and of a square or rectangular configuration. From FIG. 2 it will be noted that the tubes 210 . . . 218 extend substantially horizontally through the flue and are subject to the flow of hot gases flowing upwardly through the flue. Accordingly, additional heat is exchanged between the hot flue gases and the air flowing through the tubes. Air flow from the chamber 204 through the tubes 210 . . . 218 exits the stoveplace apparatus 10 from the chamber 112 through the mesh or screen 94 in the opening 92, as best shown in FIG. 2.

The heated air chamber 30, as best shown in FIGS. 1 and 3, is defined between the outer and inner side plates 12 and 120, respectively, upwardly between the bottom plate 60 and the horizontal plate 110 and the collar plate 150. The back or rear of the chamber 30 is defined by the inner rear wall or plate 200. The front of the chamber 30 is defined by the bottom front plate 62 and by a portion of the front plate 70 beneath the horizontal plate 110, and by a portion of the vertical front middle plate 90 above the horizontal plate 110. From the side of the apparatus 10, the chamber 30 is generally L-shaped, as may be understood by reference to FIGS. 1 and 2.

The heated air chamber 34 is substantially an identical mirror image of the chamber 30. The side walls of the chamber 34 are the outer and inner side plates 42 and 130, respectively. The chamber 34 extends upwardly from the bottom plate 60 to the horizontal plate 110 at the front of the apparatus and to the collar plate 150 at the rear of the apparatus, as does the chamber 30. The rear of the chamber 34 is the inner rear wall or back plate 200, and the front of the chamber 34 is defined by plates 64, 70 and 90.

Room air to be heated flows into the chamber 30 through the grill or mesh 18 in the opening 16 of the lower portion 14 of the outer side plate or panel 12. The air flows upwardly in the chambers 30 and 34 and flows out of the apparatus 10 either from the chamber 209 through the grill or mesh 98 in the opening 96 in the front plate 90 or from the chambers 204 and 112 through the mesh 94 in the opening 92 of the front plate 90 beneath the shelf or plate 102, as has been discussed.

As has also been stated, the collar 150 comprises the upper limit of the various walls of the stoveplace apparatus 10 except for the four walls which comprise the flue, which four walls comprise upper portions of the walls 140, 142, and upper wall panels 126 and 136. The two wall panels 126 and 136 are the flue portions of the upper portions 124 and 134 of the inner side walls 120 and 130 above the collar 150. The collar 150 is the upper limit or termination of the outer walls 12, 42, 90, 160, the inner rear wall 200, and the upper inner wall portions 124 and 134.

The collar 150 includes a central rectangular portion which is cut out so that it will fit over the flue walls 140, 126, 142, and 136. The collar, as has been stated, is appropriately secured, as by welding, to the flue walls and to the outer walls to provide air-tight connections to prevent the intermixing of combustion air, warmed air, and combustion gases. The collar 150, as best shown in FIG. 3, is slightly wider than the lower portion of the stoveplace apparatus 10 below the collar, and thus extends outwardly beyond the outer side walls 12 and 42 and outwardly or forwardly of the front plate 90. The latter is best shown in FIG. 2. However, at the rear of the stoveplace apparatus 10, the collar 150 is generally flush or even with the rear wall 160.

The collar 150 includes a cut-out portion at the rear. The cut-out portion is the area defined by the combustion air passage 164, namely tne area between the inner rear wall 200, the outer wall 160, and the outer side walls 12 and 42.

On the outer periphery of the collar 150 is disposed sections of U-bend to allow a chimney flue section such as section 320, to mate with the collar 150 and to mate with the U-bend elements on top of the four flue walls.

Figure 7:
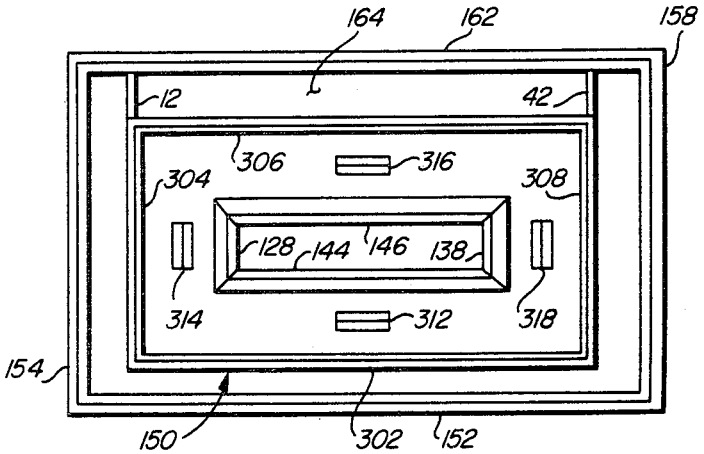
FIG. 7 is a plan view of a portion of the apparatus of the present invention taken generally along line 7—7 of FIG. 1.

The front portion of the collar 150 includes a U-bend element 152. A U-bend element 154 is disposed along one side, and a U-bend element 158 is disposed on the opposite side, substantially parallel to the U-bend element 154. The U-bend elements 152, 154, and 158 and a U-bend element 162 on top of the wall 160 are appropriately joined together at the corners to provide a continuous U-bend channel. This is best shown in FIG. 7, which is a plan view of collar 150. The U-bend elements for the collar 150 and for the rear or back wall 160 are continuous, or from a continuous channel, to allow for the securing of the outer four wall portions of a chimney flue section to mate with the stoveplace apparatus 10.

Disposed at the top of the four walls 140, 126, 142, and 136 of the upwardly extending flue or chimney section are the four U-bend elements 144, 128, 146, and 138, respectively. The four U-bend elements define a generally rectangular and continuous U-bend channel which appropriately mates with a combustion flue gas portion of a flue section to allow for the flue gases to be carried upwardly and thus to be kept separate from air flowing about the flue gas portion.

Extending upwardly on the collar 150 are U-bend elements disposed on vertical posts or supports. The posts or supports extend upwardly from the collar 150 to support their respective U-bend elements at predetermined heights above the collar 150. The U-bend elements disposed on top of the collar 150, together with the U-bend elements at the outer periphery of the collar and the rear wall and the U-bend elements on the flue walls provide for four concentrically disposed or arranged wall portions, the inner one of which defines a combustion gas flue, and the outer three are for combustion air and cooling air. The inner combustion gas flue wall portions are sealed to their counterpart wall panels at the U-bend channel. The two outermost wall portions are also sealed to their counterpart panels at their U-bend channel. The second inner wall portions, the wall portions disposed between the inner and the two outermost walls, are not sealed, but rather are spaced apart upwardly from the collar 150 to allow for the flow of air between the walls, as will be dicussed below.

Secured to the collar 150, and spaced inwardly from the U-bend channel elements 152 . . . 158 are four rectangular blades or short walls 302, 304, 306, and 308, topped with U-bend channel elements. The blades and channel elements 302 . . . 308 form a rectangular box on top of the collar 150 and adjacent to the combustion air channel 164. The wall portion 306 is disposed adjacent to the inner rear wall 200. The U-bend elements on top of the wall portions comprise a continuous rectangular channel which receives mating wall portions from a chimney flue section.

Between the inner flue walls ano the walls 302 . . . 308 are four posts topped with U-bend channels 312, 314, 316, and 318. The post-channel elements 312 . . . 318 are secured to the collar 150 and extend upwardly therefrom in a rectangular pattern as shown in FIG. 7.

The elements 312 . . . 318 extend upwardly higher than the wall and U-bend elements 302 . . . 308, but not as high as the flue walls 140, 126, 142, 136 and their U-bend elements 144, 128, 146, and 138, respectively. See FIGS. 2, 3, and 9. The U-bend elements on the posts mate with corresponding wall panels from a chimney flue section, as discussed below. The posts allow for an air flow reversal, as will be discussed below also.

A single chimney section 320 is shown in FIGS. 2 and 3 secured to the lower portion of the stoveplace apparatus 10. That is, the chimney section 320 is shown secured to the U-bend channel elements of the four flue walls, the U-bend channel elements at the outer periphery of the collar 150 and the rear or back wall 160, and to the U-bend channel elements disposed on the posts which extend upwardly from the collar 150.

The flue section 320 includes four concentric rectangular walls, each of which is made up of four panels secured together to comprise a rectangular channel. The four concentric wall channels are appropriately aligned with the U-bend elements which receive them. The four concentric walls are stepped in height inwardly, with the outer rectangular wall channel being the lowest, since it is disposed on the lowest, continuous U-bend channel elements on the collar 150 and the top of the plate 160. The innermost rectangular wall channel is the highest because it mates with the U-bend elements disposed on the top of the four flue walls. The two intermediate walls are appropriately spaced apart and they are disposed in the U-bend elements secured on the posts or supports which extend upwardly from the top of the collar 150 and on short walls on the collar.

The outermost rectangular wall structure of the chimney section 320 includes four outer wall panels or plates 322, 324, 326, and 328. They extend into, and are secured to, the U-bend elements on the collar 150 and the wall 160, namely the continuous, rectangular channel of the U-bend elements 152, 154, 156-162-157 and 158, respectively. (The "-" between the elements 156, 162, and 157 indicate that for practical purposes, the three elements comprise a continuous channel.) The plate 322 is the front plate, the plates 324 and 328 are side plates, and the plate 326 is the back or rear plate.

As best shown in FIG. 3, the back or rear plate 326 is essentially a continuation of the back plate 160, since it is generally aligned therewith. The front plate 322 and the side plates 324 and 328 are disposed slightly outwardly beyond their corresponding front and side plates of the lower portion of the stoveplace apparatus 10, as is best shown in FIGS. 2 and 3.

On the top of the four walls which comprise the upper portion of the flue, namely the upper or top portion of the front flue wall 140, the rear flue wall 142, and the upper side flue wall portions 126 and 136, each include a U-bend appropriately secured to the top of the respective flue walls. A U-bend section 144 is secured to the top of the rear flue wall 142, while U-bend elements 128 and 138 are disposed or secured to the top of the flue walls 126 and 136, respectively. As with the U-bends secured to the collar 150, the U-bends 144, 146, 128, and 138 are appropriately secured, as by welding, to the tops of their respective plates or walls. The four U-bend elements are arranged in a rectangular pattern to comprise a continuous channel substantially identical to the U-bend channel arrangement on the exterior periphery of the collar 150, as discussed above. The four U-bend elements receive four wall panels or plates which comprise the flue portion within the chimney section 320. The U-bend 144 receives a flue panel or plate 350, the U-bend 128 receives a flue panel or plate 352, the U-bend 126 receives a flue panel or plate 354, and the U-bend 138 receives a flue panel or plate 356. The flue plates or panels 350, 352, 354, and 356 are appropriately secured together, as by welding, as are the other four plates of each of the sections which define or comprise the chimney section 320. The flue walls or plates 350 . . . 356 are an extension of the flue walls or plates 140, 126, 142, and 136, and are the innermost wall channel of the chimney section 320.

Between the outer panels 322 . . . 328 and the inner, flue panels 340 . . . 346 are two baffle units, each of which comprises four plates or panels, appropriately secured together. The baffle units are disposed on and secured to the post and U-bend elements 302 . . . 318.

The outermost baffle unit includes plates or panels 330, 332, 334, and 336. The four panels 330 . . . 336 are secured to the U-bend elements 302, 304, 306, and 308, respectively.

The innermost baffle unit includes plates or panels 340, 342, 344, and 346. The four panels 340 . . . 346 are secured to the U-bend elements 312, 314, 316, and 318, respectively. The post U-bend elements 312 . . . 318 are disposed above the collar 150.

Air flows downwardly between the outermost panels 322 . . . 328 and the outermost baffle panels 330 . . . 336 and around the outer baffle panels and into the combustion air channel 164. Air also flows downwardly between the two groups of baffle panels 330 . . . 336 and 340 . . . 346. Air from the downward flow between the baffle panels reverses and flows upwardly between the inner baffle panels and the flue panels.

The outermost downward air flow is horizontally along the collar 150 and around the outer baffle walls 330 . . . 336 and downward through the combustion air channel 164. This flow of air is, of course, the air that flows through the air valve 230 and upwardly through the grates 180 to the firebox 170.

The second air flow reverses direction and flows upwardly between the baffle panels or plates 340 . . . 346 and the flue panels 350 . . . 356. This second flow of air comprises a cooling flow to help cool the exterior of the chimney flue panels. It flows outwardly from the spark arrestor and rain cap, as will be discussed below.

As has been noted, as best shown in FIGS. 2, 3, and 9, the U-bend elements which support the various plates or portions of the chimney section 320 are each disposed at a particular vertical spacing with respect to each other, with the outer plates or portions of the chimney section being the lowest, and the flue section comprising the highest. On the top of each of the four portions or channels of the chimney section 320, including the outer portion, the baffle portions, and the flue portion, are U-bends which may receive an additional chimney section therein. That is, each chimney section may be made or prefabricated for use. This allows a stack of chimney sections, or a plurality of chimney sections, to be vertically oriented so that ceilings and roofs of various heights may be accommodated by the basic stoveplace apparatus 10. The accommodation may be made by merely stacking the chimney sections 320 in a vertical manner until the desired height above a roof is achieved. A rain cap and a spark arrestor may then be secured to the top of the chimney section.

A rain cap and spark arrestor is shown in FIGS. 8, 9, 10, and 11. For illustrative purposes, only a single chimney section is illustrated herein, and the rain cap and spark arrestor illustrated in FIGS. 8, 9, 10, and 11 is disposed on top of the chimney section 320.

Figure 11:
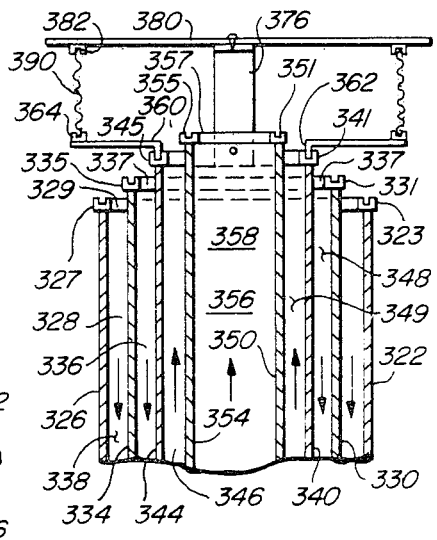
FIG. 11 is a view in partial section of a portion of the apparatus of FIG. 8, taken generally along line 11—11 of FIG. 8.
Figure 10:
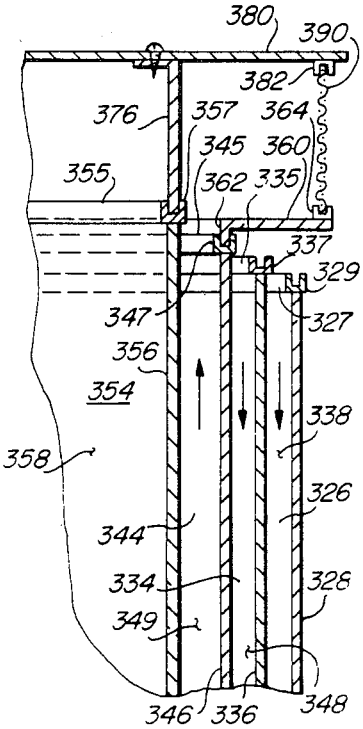
FIG. 10 is a view in partial section of a portion of the apparatus of FIG. 8, taken generally along line 10—10 of FIG. 8.
Figure 8:
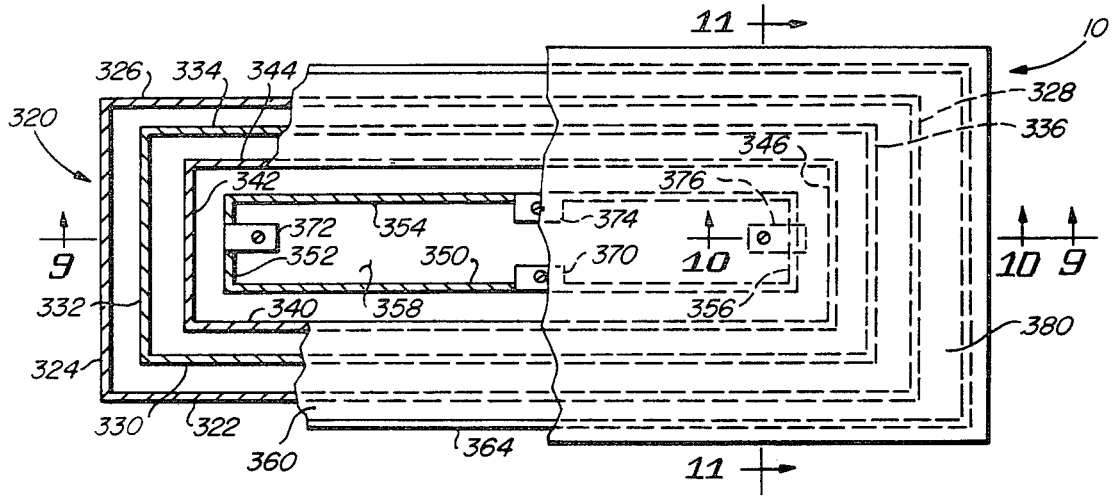
FIG. 8 is a top view, partly broken away, of a portion of the apparatus of the present invention.

FIG. 8 is a view of the top of the apparatus 10 looking downwardly through the flue area, with portions of the rain cap and spark arrestor elements removed to show the four concentrically disposed wall systems which comprise the chimney section 320. FIG. 9 is a view in partial section of the flue apparatus 320 of FIG. 8, taken generally along line 9—9 of FIG. 8. FIG. 10 is a view in partial section of the chimney flue apparatus 320 of FIG. 8, taken generally along line 10—10 of FIG. 8. FIG. 11 is a view in partial section of the apparatus of FIG. 8, taken generally along line 11—11. For the following discussion concerning the chimney flue section 320 and the relationship of the spark arrestor and rain cap to the chimney flue section 320, reference will be made primarily to FIGS. 8, 9, 10, and 11.

As has been stated above, each chimney section, such as the chimney section 320, includes U-bend elements secured to the tops of the various walls which comprise each chimney section. As has also been stated, the wall height of each of the four concentric walls increases slightly, thus making it relatively easy to secure one flue section on top of another flue section. However, for illustrative purposes, only one chimney flue section 320 is illustrated and is discussed herein.

As shown in FIGS. 9, 10, and 11, each of the four wall sections which comprise the chimney flue section 320 includes U-bend elements disposed on and secured to the top of each of the wall plates or panels. The four outer wall panels 322, 324, 326, and 328 each include U-bend elements secured thereto. U-bend element 323 is disposed on and secured to the front outer panel 322, U-bend element 325 is secured to the outer side panel 324, U-bend element 327 is secured to the rear outer panel or plate 326, and U-bend element 329 is secured to the side plate or panel 328.

The front center baffle panel 330 includes the U-bend element 331 disposed on its top, the side center baffle panel 332 includes a U-bend element 333 disposed on its top, the rear center baffle panel 334 includes a U-bend element 335 secured to it, and the side center baffle panel 336 includes a U-bend element 337 secured to it.

The front baffle plate or panel 340 includes a U-bend element 341 secured to it. The side, rear, and side baffle panels 342, 344, and 346, respectively, also include respective U-bend elements 343, 345, and 347 secured to them.

The front, side, rear, and side flue panels 350, 352, 354, and 356, respectively, include respective U-bend elements 351, 353, 355, and 357 disposed on and secured to the top of them.

The U-bend elements facilitate the stacking of one chimney flue section on top of the other until the desired height is obtained. The U-bend elements are secured to the respective plates or panels by appropriate means, such as welding. The four U-bend elements secured to the tops of the four panels defining a single unit comprise a continuous U-bend channel which may receive the corresponding four wall plates or panels of a mating chimney section.

For securing the rain cap and spark arrestor assembly to the chimney flue section, the U-bend elements for the outer two wall units, including elements 323, 325, 327, 329, and 331, 333, 335, 337 are not used. The U-bend elements 341, 343, 345, and 347 of the front baffle panel 340, the side baffle panel 342, the rear baffle panel 344, and the side baffle panel 346, respectively, are utilized. The U-bend elements 341 . . . 347 receive a downwardly depending flange 362 of a plate 360. See FIG. 11. The plate 360 is generally of a rectangular configuration with a rectangular cut-out portion in the center and the downwardly depending flange 362 borders the cut-out portion. The plate 360 extends outwardly from the four walls or panels to which it is secured for a distance slightly outside or beyond the four outer panels or plates 322 . . . 328. This is shown in FIGS. 8, 9, 10, and 11. As will be understood, the flange 362, which extends downwardly from the interior periphery of the plate 360, is generally of a rectangular configuration, and its four portions are received into the U-bend sections 341 . . . 347 of the four baffle plates 340 . . . 346. Extending upwardly from the top surface of the plate 360, and disposed adjacent to its four outer peripheral edges, is a U-bend section 364. The U-bend 364 is, of course, rectangularly configured in accordance with the general configuration of the plate 360, and it comprises a continuous U-bend channel.

Extending upwardly from the U-bend elements 351, 353, 355, and 357 disposed on the flue walls 350, 352, 354, and 356, respectively, and generally centered with respect to the U-bends and to the flue walls, are four vertical support brackets. A vertical support bracket 370 is secured to U-bend 351 disposed on the front flue wall 350. A vertical support bracket or element 372 is secured to the U-bend 353 disposed on the top of the side flue wall 352. A vertical support bracket 374 is disposed in U-bend 355 which is secured to the top of the rear flue wall 354, and vertical support bracket 376 is secured to U-bend 357 on the top of the side flue wall 356. The purpose of the vertical supports 370, 372, 374, and 376 is to provide structural support for a rain cap 380. The rain cap 380 is a metal plate which is of a generally rectangular configuration. Its outer four edges extend outwardly beyond the outer four edges of the plate 360, as shown in FIGS. 8, 9, 10, and 11, for rain protection. As best understood from FIG. 8, the vertical supports 370 . . . 376 provide structural support for the rain cap plate 380 towards the center of the rain cap plate. The rain cap plate 380 includes a U-bend element 382 disposed on the lower side of the plate 380 and inwardly from the outer periphery of the plate 380. The U-bend element 382 is generally rectangularly configured, and is best shown in FIGS. 9, 10, and 11. The U-bend element 382 is aligned in a generally parallel relationship with the U-bend element 364 which is secured to the upper side of the plate 360. The U-bend element 382 defines a continuous U-bend channel.

The plates 360 and 380 are spaced apart a predetermined distance, and a hardware cloth screen 390 extends between the two plates. The hardware cloth screen 390 is disposed in the U-bend channels 364 and 382 of the plate 360 and the rain cap 380, respectively. The screen 390 serves as a spark arrestor to prevent sparks, etc., which may flow up the flue, from escaping.

The four walls 350, 352, 354, and 356 which comprise the flue define a vertical chamber 358. The chamber 358 is a flue channel which is a continuation of the flue channel extending upwardly from the firebox 170. The combustion gases flow upwardly through this flue channel.

On both sides of the four baffle walls 340, 342, 344, and 346 are channels through which pass cooling air. The two channels are respectively a down channel 348 and an up channel 349. See FIG. 10. The down channel 348 extends between the eight panels or walls 330, 332, 334, 336, and 340, 342, 344, and 346. The up channel 349 extends between the four flue walls 350, 352, 354, and 356 and the four baffle walls 340, 342, 344, and 346. The cooling air flow which flows downwardly in the channel 348 flows upwardly through the channel 349. This is shown best by the arrows in FIG. 9. The four inner supports 312, 314, 316, and 318, which extend upwardly from the collar 150, receive the lower portions, and accordingly support, the respective four baffle walls or panels 340 . . . 346. Thus, there is a space above the collar 150 in which the downwardly flowing air in the channel 348 reverses itself and flows upwardly through the channel 349.

The downward flow of air through the channel 348 begins beneath the plate 360 and above the top or upper portion of the wall panels 330, 332, 334, and 336. The flow of air in the channels 348 and 349 is by natural convection, and it comprises a cooling flow of air for the four walls or panels 350 . . . 356 of the flue. The air in the up channel 349 is warmed from the walls of the flue and naturally flows upwardly. The upward flow of air in channel 349 is replaced and is forced upwardly by a downward flow of air through the down channel 348.

Another down channel 338 for cooling and combustion air is defined between the outer wall plates or panels 322, 324, 326, and 328 and the four baffle panels or plates 330, 332, 334, and 336. The air from channel 338 flows over the collar plate 150 and around the outer baffle panels 330 . . . 336 and flows downwardly between the rear plates 160 and 200 in the channel 164 as discussed above. This flow of air is best illustrated in FIG. 2, and may be visualized by reference to FIG. 7.

It will be noted that the three air flows, in the channels 338, 348, and 358, are kept separate from the combustion gas flow in the flue channel 358. The four walls of the chimney flue are insulated by the three different flows of air, the two down air flows in the outer channels 338 and 348, and the flow of the flue coolant air in the channel 349.

The free-standing stoveplace apparatus 10 may be disposed virtually in any desired location within a structure, with the chimney flue sections extending upwardly through the ceiling, roof, etc., without the need of additional insulation disposed about the flue sections. The flue sections as described provide separate coolant air flows so as to insulate the structure from the combustion gases flowing upwardly through the center channel 358. At the same time, combustion air, fresh from outside the structure in which the apparatus is disposed, is provided as an air flow separate and distinct from the room within the structure which is utilized for heating purposes in the lower portion of the stoveplace apparatus. The room air circulates into, through, and out of the apparatus 10.

The combustion air flowing downwardly in channel 338 is pre-warmed as it flows in channel 338 and in channel 164. The pre-heating increases combustion efficiency.

Air from outside the structure or home does double duty as insulative air and as combustion air. The combustion air helps to insulate the chimney flue and also the back of the apparatus. With the combustion air coming from outside the structure, negative pressure problems are substantially eliminated. Finally, the rate of combustion is controlled by means of an air valve which controls the flow of combustion air to the firebox.

While a rectangular chimney flue section and a rectangular apparatus has been discussed and is illustrated, it is obvious that the same discussion and principles involved also apply to a circular apparatus, with a circular chimney flue section. That is, the inner and outer side walls and the lower flue portion and the chimney section may be circularly curved, if desired. Moreover, the chimney flue section may be circular and may mate with a rectangular lower stoveplace apparatus. Such alternatives are within the ambit of the present invention.

For using the stove/furnace or stoveplace apparatus 10, the doors 82 and 84 are opened, and fuel is loaded into the firebox and placed on the grates 180. The air valve 230 is adjusted to provide the appropriate amount of combustion air from the combustion passage 164 to the firebox 170 by moving the lever or actuating arm 238 to move the vane 232.

After the fire is started in the combustion chamber 170, the doors 82 and 84 are closed to prevent room air from being drawn into the firebox 170. The only air for combustion purposes accordingly is through the air valve 230 from the combustion air passage 164.

Room air to be heated flows into the various heated air or warm air chambers of the stoveplace apparatus 10 through the four openings. The four openings include the openings 16 and 46 in the lower side wall portions 14 and 44, respectively, for the chambers 30 and 34, respectively, the opening 72 for the manifold 190, the grates 180, and the chamber 204, and the opening 76 for the chamber 112. Air from the side chambers 30 and 34 flows into the chamber 204 to mix with the air flowing through the grates 180. The air from the chamber 204 then flows through the plurality of tubes 210 . . . 218 to the upper portion of the chamber 112 and thence out of the apparatus 10 through the opening 92. Air flowing upwardly in the chambers 30 and 34 also flows into the chambers 208 and 209 and ultimately into the apparatus 10 through the opening 96. It will be noted that the air flow into the warm air or heated air chambers in the stoveplace apparatus 10 blends together since there is communication among the various chambers as discussed in detail above. In addition to the chambers that virtually surround the combustion chamber 170 and the flue 139, heat is also exchanged through the tubes 210 . . . 218 which extend through the flue 139 and through the grates 180. The heat exchanged in the tubes 210 . . . 218 is from the hot combustion gases flowing upwardly in the flue 139. Thus, the various walls or plates, the grates 180, and the tubes 210 . . . 218 comprise heat exchange elements, and the air flowing along or adjacent to them or through them is appropriately heated.

Heat extraction is exchanged by the double level of the outlets 92 and 96. The mid outlet 92 lets the hottest air out of the unit and reduces the temperature of the air flowing higher in the apparatus so that a greater amount of heat can be extracted. The hottest air comes out at the mid point opening outlet 92 and the cooler air flowing upwardly and out the outlet or opening 96 from up above in the apparatus.

Since heat flows in one direction only, from a hotter to a cooler temperature, it follows that the lower the temperature of the air above the outlet 92, the greater the amount of heat that can be extracted from the apparatus between the outlet 92 and the outlet 96. Thus, the use of outlets for heated air at the two levels enhances the heat extraction or heat recovery from the apparatus.

For insulation purposes, the stoveplace apparatus 10 is supported upwardly on four legs 52, 54, 56, and 58. This keeps the stoveplace apparatus off the floor on which it is disposed so as to allow for a flow of insulative room air beneath the apparatus. The space between the grates 180, which comprises the bottom of the firebox or combustion chamber 170, and the bottom plate 60, also provides for additional insulation by virtue of the flow of combustion air from the combustion air channel 164 through the air valve 230. Thus, there is double insulation by virtue of air beneath the firebox 170 and additional pre-heating of the combustion air.

The combustion air chamber or channel 164 provides for additional insulation at the rear of the apparatus. The combustion air flows downwardly and at the same time there is an upward flow of heated air in the chambers 204 and 208, and which latter air flows ultimately out of the apparatus 10 through the openings 92 and 96, respectively.

Above the collar 150, which comprises the top or upper limit of the heated air chambers in the apparatus 10, there are two downwardly flows of insulative air within the chimney flue section 320. One of the air flows, the air flow in chamber 348, reverses and flows upwardly in channel 349 about the periphery of the flue plates or panels 350 . . . 356. The outer air in channel 338 ultimately flows downwardly through the combustion air passage or channel 164. Thus, about the upper portion of the flue 139 and throughout the length of the flue passage 358 above the collar 150, there are three flows of insulative air, two outer and downward flows and one upper, inner flow. These three flows of air serve to further insulate the four walls which define the flue channel 358. The three flows, the two downwardly flows in the outer channel 338, the middle channel 348, and the upper flow in the inner channel 349 serve as additional insulation to prevent excess heat buildup through the ceiling, the attic, and the roof, through which the chimney flue section(s) 320 extend(s).

As has been explained, a plurality of chimney flue sections 320 may be stacked on top of each other and appropriately secured by virtue of the U-bend elements on the top of each concentric wall layer to provide the necessary height for clearing roofs, etc. The chimney flue sections are preferably secured together at the U-bend channels by sheet metal screws or other appropriate fasteners.

Finally, a rain cap and spark arrestor unit is secured to the top of the upper chimney flue section. The rain cap and spark arrestor is secured to both the inner baffle wall plates and the flue channel wall plates. Between the outer wall plates and the outer baffle wall plates is the first or outer down channel 338 for air, and between the outer and inner channel wall plates is the second down air channel 348. Between the four flue walls 350 . . . 356 and the inner baffle walls 340 . . . 346 is the up air channel 349. The air flowing downwardly in both the two down channels 338 and 348 is kept separate. The air from channel 338 flows downwardly through the combustion air or passage 164 and the air flowing downwardly in channel 348 flows upwardly in the channel 349.

There are three separate and independent air flows within the stoveplace apparatus 10. Two of the air flows are outside air, with one being for insulative purposes and the other for combustion purposes. The third air flow is room air circulating through the various chambers being warmed or heated. The room air returns to the room after extracting heat from the apparatus. The flow of combustion gases upwardly through the flue 139 and through the flue channel or passage 358 comprises a fourth flow if a distinction is desired between the downward flow of combustion air and the upward flow of combustion gases.

The combustion air, as has been discussed, serves as an insulative flow of air. That is, it helps to insulate the apparatus as the air flows downwardly through the roof, in the attic, and through the ceiling. While the combustion air is flowing downwardly, it is warmed by the heat in the apparatus. The heat which is received serves to pre-heat the combustion air. This pre-heating of the combustion air increases the efficiency of the burning of the fuel in the firebox 170. Since the combustion air is pre-heated, the production of creosote is reduced and more complete combustion takes place than if the air were not pre-heated. This pre-heating function is especially meaningful in cold climates, where the outside air temperature is relatively low. The extent of the pre-heating increases the closer the flow of combustion air comes to the air valve 230 as is obvious.

The down and up insulative air flow in the chimney section actually comprises a double flow of air, with the flows separated by baffle plates. One flow is downwardly, and the other flow is upwardly. They are referred to herein as a single flow since only their directional change differentiates them due to their common origin, common path, and common exit, all concerned with the chimney section(s). It will be understood that the upward flow has a higher temperature than the downward flow, of course.

The third air flow, the warm air flow, originates in the room about the apparatus 10 and circulates within the apparatus due to convection. The room air enters the apparatus 10 at a relatively low location, rises and flows within the apparatus as it is warmed, and flows out of the apparatus at a relatively high location.

The employment of the double walls of the stoveplace apparatus 10 permits the circulation of warm air throughout the various chambers within the apparatus, which, in a free-standing unit, enhances not only the heating aspects of the apparatus but also the safety aspects. Essentially, convection heat is traded for radiant heat. Thus, the hot exterior of free-standing units, with their inherent safety problems, is traded for a double wall unit which heats primarily by convection. As is well known and understood, convection heating is preferable to radiant heat.

The chimney flue section 320 is preferably secured to the various U-bend channels on collar 150 and on the U-bend elements on the flue 139 by sheet metal screws or other appropriate fasteners. Sheet metal screws and the like may also be used to secure additional chimney flue sections together and to secure the rain cap and spark arrestor unit to the top of the uppermost chimney flue section.

The grates 180 and their manifold 190 may be fabricated as a unit and bolted, or the like, to the appropriate walls, if desired. Such fabrication and assembly would facilitate removal of the grate and manifold unit for repair or replacement. Similarly, the air valve 230 may be fabricated as an assembly or unit and may be installed by bolts or other appropriate fasteners.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Free-standing fireplace apparatus for a room, comprising, in combination:

combustion chamber means in which combustion occurs to provide heat and including a front portion, a rear portion, and first and second side portions;

chimney flue means communicating with the combustion chamber and extending upwardly therefrom through which combustion gases flow from the combustion chamber and out of the structure in which the fireplace apparatus is disposed;

heated air chamber means through which air flows to be heated by the heat from the combustion chamber means, including a first heated air chamber adjacent to the first side portion of the combustion chamber means and the chimney flue means, a second heated air chamber adjacent to the second side portion of the combustion chamber means and the chimney flue means, third heated air chamber means adjacent to the rear portion of the combustion chamber means and the chimney flue means and communicating with the first and second heated air chambers at a lower part of the third heated air chamber means, and fourth heated air chamber means above the combustion chamber means communicating with the third heated air chamber means through the chimney flue means; and combustion air means disposed rearwardly of and adjacent to the first and second heated air chambers and the third heated air chamber means and disposed about the chimney flue means for providing a flow of outside air to the combustion chamber for warming the air to the combustion chamber and for cooling the combustion gases flowing through the chimney flue means; and opening means through which air flows into and out of the heated air chamber means, including a first opening in the first heated air chamber through which room air flows into the first heated air chamber, a second opening in the second heated air chamber through which room air flows into the second heated air chamber, a third opening below the first side portion of the combustion chamber means and communicating with the third heated air chamber means through which room air flows into the third heated air chamber means, a first outlet through which heated air flows from the fourth heated air chamber means, and a second outlet above the first outlet through which heated air flows from the first and second heated air chambers.

2. The apparatus of claim 1 in which the combustion chamber means includes a combustion chamber communicating with the chimney flue means and door means for preventing air from within the structure in which the apparatus is disposed from flowing into the combustion chamber when the door means is closed and for adding fuel to the combustion chamber when the door means is open.

3. The apparatus of claim 2 in which the fourth heated air chamber means includes a fourth heated air chamber and a fourth opening above the door means through which room air flows generally horizontally into the fourth heated air chamber.

4. The apparatus of claim 3 in which the fourth heated air chamber means further includes a first generally horizontal portion above the combustion chamber, a second generally vertical portion comprising a continuation of the first portion and disposed in front of the chimney flue means, and a horizontally extending stove top comprising the top of the first portion.

5. The apparatus of claim 1 in which the third heated air chamber means includes a third heated air chamber between the combustion chamber and chimney flue means and the combustion air means, a manifold remote from the third heated air chamber to which air to be heated flows through the third opening, and hollow grate means extending from the manifold to the third heated air chamber for supporting the fuel to be combusted and for providing an air flow from the manifold to the third heated air chamber.

6. The apparatus of claim 5 in which air flows from the first and second heated air chambers to the third heated air chamber.

7. The apparatus of claim 5 in which the combustion air means includes a combustion air passage extending adjacent to the third heated air chamber and remote from the fourth heated air chamber means for pre-heating the combustion air flowing in the said passage and an air valve for controlling the flow of combustion air from the combustion air passage to the combustion chamber means.

8. The apparatus of claim 1 in which the fourth heated air chamber means includes a first portion above the combustion chamber means and a second portion communicating with the first portion and disposed in front of the chimney flue means.

9. The apparatus of claim 8 in which the third heated air chamber means includes a third heated air chamber and tube means extending through the chimney flue means for providing communication between the third heated air chamber and the second portion of the fourth heated air chamber means and comprising heat exchange means for heating the air flowing through the tube means with heat from the combustion gases flowing in the chimney flue means.

10. The apparatus of claim 1 in which the heated air chamber means further includes a fifth heated air chamber and a sixth heated air chamber disposed above the third and fourth heated air chamber means, respectively.

11. The apparatus of claim 10 in which the first and second heated air chambers communicate with and provide a flow of air to the fifth heated air chamber and the sixth heated air chamber.

12. The apparatus of claim 11 in which heated air from the first, second, and fifth heated air chambers flows out of the apparatus from the sixth heated air chamber through the second outlet.

13. The apparatus of claim 10 in which the heated air chamber means further includes a collar disposed about the chimney flue means which comprises the top of the first, second, fifth, and sixth heated air chambers.

14. The apparatus of claim 13 in which the chimney flue means includes a chimney flue extending through the collar.

15. The apparatus of claim 14 in which the chimney flue means further includes a chimney flue section disposed above the collar and the chimney flue.

16. The apparatus of claim 15 in which the collar and the chimney flue include means for securing the chimney flue section to the collar and to the chimney flue.

17. The apparatus of claim 16 in which the means for securing the chimney flue and the collar to the chimney flue section comprises a plurality of U-bend elements secured to the collar and to the chimney flue.

18. The apparatus of claim 15 in which the chimney flue section includes a flue portion through which combustion gases flow from the chimney flue.

19. The apparatus of claim 18 in which the chimney flue section further includes baffle means for providing a downward flow of air remote from the flue portion and an upward flow of air adjacent to the flue portion for insulating the flue portion.

20. The apparatus of claim 19 in which a portion of the downward flow of air from the chimney flue section communicates with the combustion air means to provide a flow of air to the combustion chamber means.

21. The apparatus of claim 19 in which the baffle means includes an inner baffle portion and an outer baffle portion to provide a first and a second downward flow of air remote from the flue portion.

22. The apparatus of claim 21 in which the inner baffle portion is secured to the collar and spaced above the collar and the first downward flow of air flows underneath the first baffle portion and upwardly about the flue portion for cooling the flue portion.

23. The apparatus of claim 22 in which the outer baffle means is secured to the collar and the second downward flow of air flows about the outer baffle and downwardly in the combustion air means.

24. The apparatus of claim 15 in which the chimney flue means further includes a rain cap and spark arrestor secured to the chimney flue section.

25. The apparatus of claim 24 in which the chimney flue section includes a plurality of U-bend elements for receiving and securing the rain cap and spark arrestor to the chimney flue section.

* * * * *